United States Patent [19]

Eickmann

[11] 3,949,648

[45] Apr. 13, 1976

[54] ROTARY RADIAL PISTON MACHINE WITH RADIAL EXTENSION ON THE PISTON SHOE ENDS

[76] Inventor: Karl Eickmann, 2420 Isshiki, Hayama, Kanagawa, Japan

[22] Filed: May 2, 1974

[21] Appl. No.: 466,246

[30] Foreign Application Priority Data

May 4, 1973 Austria ..... 3967/73

[52] U.S. Cl. ..... 91/492; 92/72; 92/187

[51] Int. Cl.[2]..... F01B 1/06; F01B 13/06; F16J 1/14

[58] Field of Search ..... 91/488, 497, 491, 492; 92/72, 187

[56] References Cited

UNITED STATES PATENTS

| | | | |
|---|---|---|---|
| 2,620,733 | 12/1952 | Overbeke | 91/491 |
| 3,063,380 | 11/1962 | Strickland | 91/488 |
| 3,398,698 | 8/1968 | Eickmann | 91/497 |
| 3,765,183 | 10/1973 | Baurle | 91/492 |

FOREIGN PATENTS OR APPLICATIONS

| | | | |
|---|---|---|---|
| 745,216 | 2/1933 | France | 91/497 |
| 1,528,358 | 6/1970 | Germany | 91/491 |
| 548,566 | 9/1956 | Italy | 91/491 |
| 829,241 | 3/1960 | United Kingdom | 91/492 |
| 1,816,435 | 6/1970 | Germany | 91/491 |

*Primary Examiner*—John J. Vrablik
*Attorney, Agent, or Firm*—Michael J. Striker

[57] ABSTRACT

A rotor is rotatably mounted in a housing and formed with angularly spaced radially oriented cylinder bores in each of which a piston is radially reciprocable. The radially outer end of each piston is formed with an inwardly extending recess having a length greater than the length of the piston stroke. A control ring which is eccentric relative to the rotor surrounds the latter, and its inner circumferential surface is slidingly contacted by respective piston shoes each of which is associated with one of the pistons and each of which has a shaft that is freely received in the recess of the associated piston and whose length is also greater than the length of the piston stroke.

11 Claims, 5 Drawing Figures

ROTARY RADIAL PISTON MACHINE WITH RADIAL EXTENSION ON THE PISTON SHOE ENDS

BACKGROUND OF THE INVENTION

The present invention relates generally to a fluid-handling machine, and more particularly to a radial-piston fluid-handling machine. In particular, the present invention relates to a radial-piston fluid-handling machine provided with means for preventing the separation of piston shoes from the associated pistons.

Radial-piston fluid-handling machines are already well known in the art, and require no detailed description as to their general concept and operation. Generally speaking, they have a rotor which is formed with angularly spaced radially oriented cylinder bores in each of which a piston is radially reciprocable. The outer end of the piston carries a piston shoe which is in sliding engagement with a control ring or with an inner circumferential surface of a surrounding housing, and since this surface of a control ring is eccentric with reference to the rotor, relative rotation of the rotor and the control ring will result in reciprocation of the piston. A machine of this general type is, for instance, disclosed in my own prior U.S. Pat. No. 3,223,046 to which reference may be had for further details concerning the prior art.

Generally speaking, the piston shoes via whose sliding contact with the control ring or similar instrumentality the reciprocation of the pistons is effected, are connected with the associated pistons and thus cannot become separated therefrom. The connection is usually of a type permitting a certain degree of pivoting movement of piston shoe relative to piston, which requires that the piston shoe be provided with a portion that is engaged in a seat formed in the piston. Generally, these prior-art constructions operate very well, but it has been observed that in certain circumstances--for instance if the rotor turns at high or very high speeds--the piston shoe may become detached from its seat in the piston and separate sufficiently from the latter to become wedged in the space between the rotor and the control ring or the inner control surface of the housing. When this occurs, the piston shoe is, of course, immediately broken apart into many pieces; more importantly, however, the piston shoe will within seconds so damage the rotor and the housing and/or control ring that the entire machine becomes unuseable.

SUMMARY OF THE INVENTION

Accordingly, it is a general object of the invention to overcome the disadvantages of the prior art.

More particularly, it is an object of the invention to provide an improved radial-piston fluid-handling machine wherein the danger is completely avoided that the piston shoe might become wedged between and damage the rotor and the control ring and/or housing.

In keeping with the above objects and with others which will become apparent hereafter, one feature of the invention resides in a radial-piston fluid-handling machine which comprises, briefly stated, a housing and a rotor rotatably mounted in the housing and having angularly spaced radially oriented cylinder bores. A piston is located in each of these bores and is radially reciprocable through a stroke of a first length, each such piston having a radially outer end formed with an inwardly extending recess of a greater second length. Means is provided for effecting radial reciprocation of the pistons when the rotor rotates, including a control ring which surrounds the rotor and has an inwardly directed annular control face that is eccentric relative to the rotor. A piston shoe is associated with each piston and has a first portion in sliding contact with the annular control face, and a second portion which extends from the first portion by a third length greater than the first length but at most equal to the second length and which is freely received in the recess of the associated piston.

The piston shoe is now no longer firmly connected with the associated piston at all, but instead its second portion—which in effect is a shaft—is freely and loosely received in the associated recess of its piston, so that under the influence of centrifugal force the piston shoe can lift off its associated seat and can move freely within certain limits. Despite this, however, it is assured that the piston shoe can never move relative to its associated piston in such a manner that it could become wedged between the rotor and the means for effecting radial reciprocation of the pistons. Moreover, it is assured that when the piston shoe subsequently moves inwardly again, so that its second portion moves back into engagement with its seat in the piston, the second portion will automatically become centered and guided back onto the seat.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figures 1, 2:
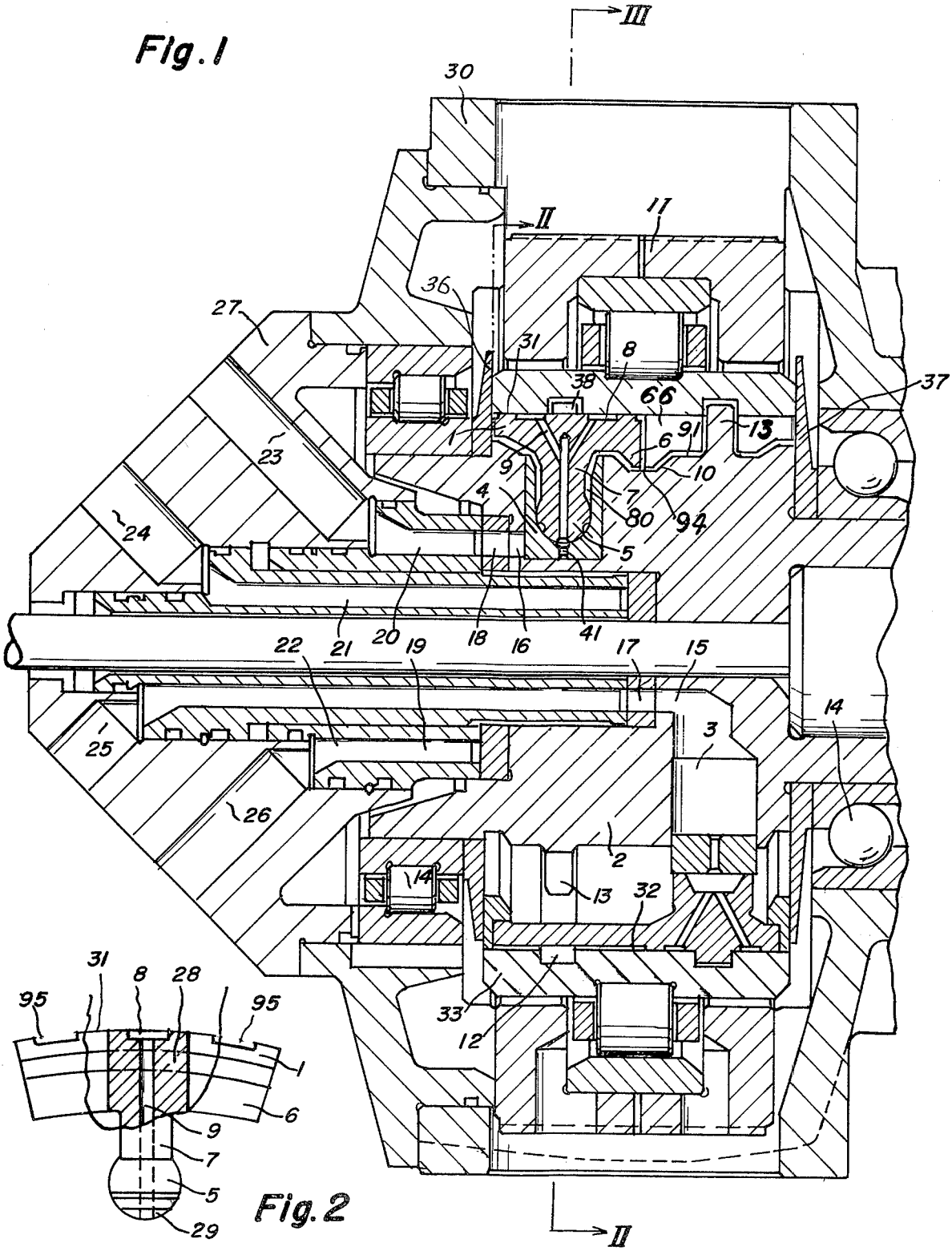
FIG. 1 is an axial section through a radial-piston machine which embodies the present invention.
FIG. 2 is a fragmentary section taken on line II—II of FIG. 1.

FIGS. 1 and 2 show an exemplary embodiment of the invention, wherein a rotor 2 of a radial-piston fluid-handling machine—such as a pump, a motor or the like—is mounted for rotation in a housing 30 by means of anti-friction bearings 14. The rotor 2 is surrounded with clearance by a control ring 33 which has a radially inwardly directed circumferential surface 32; the latter may be formed with at least one annular groove 12.

The rotor 2 is formed with a plurality of cylinder bores 3 which are spaced about its circumference and which are radially oriented relative to the axis of rotation of the rotor 2. Each of the cylinder bores 3 accommodates a piston 4 which is reciprocable alternately in radially inward and radially outward directions, as is known from the art. The consequent sequential increase and decrease of the fluid chamber defined in the respective cylinder bore results in the entry and expulsion of fluid therefrom, again in accordance with the prior art.

As is also known from the prior art, each of the pistons 4 is associated with a piston shoe 1 which engages the inner circumferential surface 32 of the control ring 33 in sliding relationship, and which thus causes the reciprocatory movement of its associated piston 4 due to the fact that the control ring 33 is eccentric with reference to the rotor 2, i.e., the distance from the axis of rotation of the control ring 33 (which coincides with the axis of rotation of the rotor 2) to the inner circumferential surface 32 is different at different circumferential locations of this surface. The radially outward ends of the pistons 4 are each formed with a recess 80 which extends axially of the respective piston, that is inwardly of the outer end, and the inner end portion of which is formed as a part-spherical seat for engagement by a base portion 5 of the associated piston shoe 1, which base portion 5 is connected with the outer part of the piston shoe (the part located exteriorly of the cylinder bore 3 and the piston 4) by a neck portion 7. It will be appreciated that the portions 5 and 7 together in effect constitute a shaft of the respective piston shoe 1.

The manner of so mounting a piston shoe in the associated piston of a radial-piston fluid-handling machine is known per se from the prior art. However, what is not known and what is novel according to the present invention is the fact that the axial length of the shaft composed of the portions 5 and 7 (i.e., the length axially of the respective piston 4), and similarly the axial length of the recess 80 are greater than the length of the stroke which can be performed by the piston 4. This prevents the piston shoe 1 from becoming separated or falling out of the piston 4, and thus precludes the possibility that the difficulties could occur which have been observed in the prior art. Even under circumstances in which the piston 4 assumes its radially farthest inward position, and at the same time the associated piston shoe 1 assumes its radially farthest outward position, the piston shoe base portion 5 will still be partly located within the recess 80 and thus reliably prevent the occurrence of the aforementioned difficulties. It should be noted, incidentally, that the recess 30*a* may be slightly convergent in direction towards the outer end of the piston 4, to facilitate the automatic guidance and centering of the portions 5 and 7 when the piston shoe moves radially inwardly with reference to its associated piston 4.

The outer portion of the piston shoe 1, that is the portion that is located outwardly of the cylinder 3 and the piston 4, is extended beyond the circumferential outline of the cylinder 3 in direction axially of the rotor 2 and provided with one or more guide faces 31 which engage the inner circumferential surface 32 of the control ring 33 in sliding relationship, and which are of such length in circumferential direction of the control ring 3 that their elongation in this direction is greater than the overall axial length of the piston shoe 1; that is, its extension in the axial direction of the associated piston 4. This construction has the advantage that any tilting or skewing of the piston shoe 1 with reference to the associated piston 4 is reliably and completely precluded.

The rotor 2 is provided with a pair of radially projecting axially spaced portions 36, 37 and each piston shoe 1 is provided at one axial end (the term axial here refers to the axial elongation of the rotor) with a further guide face which is juxtaposed with one or the other of the wall portions 36, 37. It is possible to have this guide face contact the associated wall portion 36, 37, but because of the friction which thus occurs it is desirable that there should be sufficient play so that there is no such contact under ordinary circumstances.

The embodiment of the machine according to the present invention that is illustrated in FIGS. 1 and 2, is of the type having two groups of cylinders, two groups of pistons and two groups of associated piston shoes, with the groups being axially spaced (axially of the rotor) from one another. When such a dual or multiple-group construction is chosen, then the outer circumferential surface of the rotor 2 is advantageously formed with a circumferentially extending groove 10, and each of the piston shoes 1 is formed adjacent one of its ends which face in axial direction of the rotor with a radially inwardly extending projection 6 which extends radially inwardly towards the axis of rotation of the rotor 2 by an extent which is greater than the degree of eccentricity between rotor 2 and control ring 33. This projection 6 then extends into the groove 10, as shown in FIG. 1. The projections 6 of axially adjacent ones of the piston shoes 1 are closely adjacent and should advantageously be slightly spaced to prevent contact with one another. This is clearly shown in FIG. 1 from which which it will also be apparent that even if one of the piston shoes 1 is in its radially innermost position and at the same time the axially adjacent piston shoe is in its radially outermost position, the associated closely adjacent projections 6 will still overlap to some extent in radial direction of the machine, so that each piston shoe 1 prevents the other from tilting in axial direction, especially due to the fact that the radial extent of each projection 6 is greater than the degree of eccentricity of the rotor 2 and the control ring 33.

It is advantageous if each of the piston shoes 1 is provided with hydrostatic bearings 8 and 29 which are connected by passages 9 and which receive fluid under pressure through a bore 41 formed in the associated piston, these hydrostatic bearings being provided between the piston shoe 1 and the associated piston 4 or the surface 32. The provision of such hydrostatic bearings is already known from my aforementioned prior U.S. patent.

To obtain a rather large piston stroke, and thus to obtain high capacity for the machine, it is advantageous if the portion 28 of the piston shoe which connects the axially extending end sections thereof with one another and with the shaft 5, 7, is narrow enough so that it can enter into the rotor slot 38, and if the rotor portions 13 located between the rotor slots can extend into the groove 12 in the control ring 33. It is also advantageous if the neck portion 7 of the piston shoe 1 is of lesser diameter than the base portion 5, as shown in FIG. 1.

An end member 27 is provided with a plurality of fluid ports 23, 24, 25 and 26, which communicate with fluid passages 15–22 and serve for the entry and exit of fluid relative to the machine. It will be appreciated that if the machine operates as a pump, it is advantageous if the fluid that is supplied to it will already be under some pressure so that the pistons 4 and the associated piston shoes 1 will be pressed into their radially outermost end positions during the intake stroke.

Figure 3:
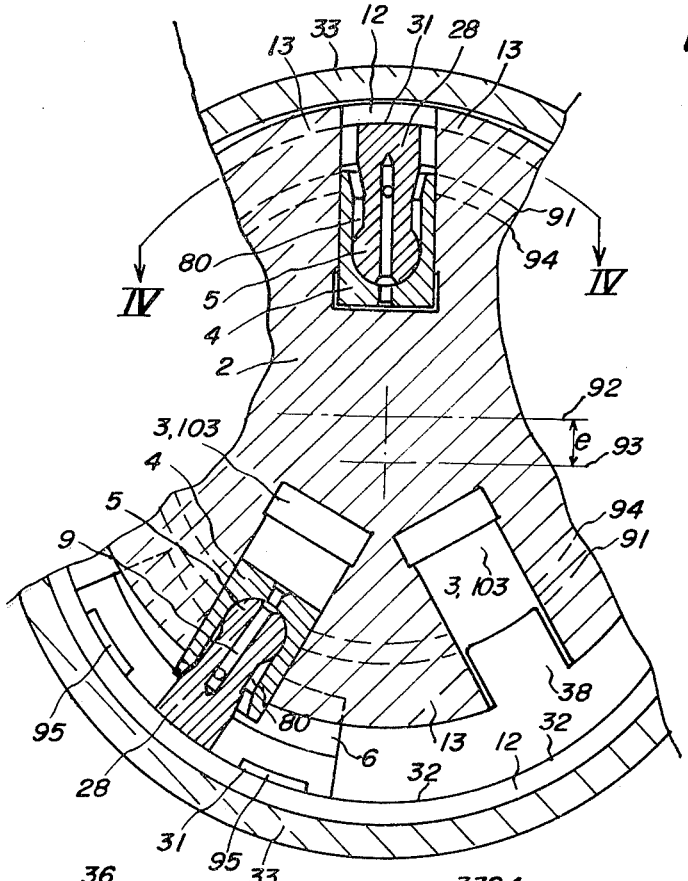
FIG. 3 is a partial section through FIG. 1 along the line III—III.
Figure 4:
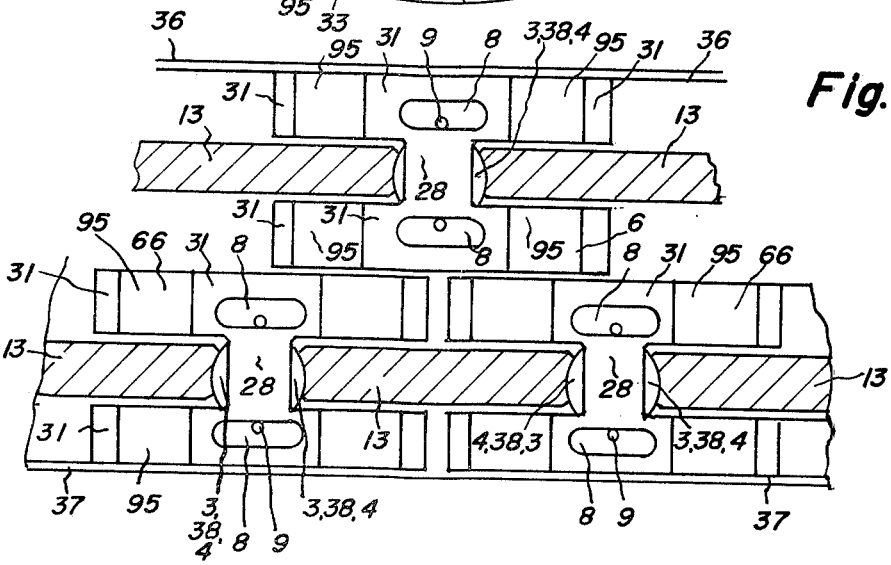
FIG. 4 is a section through FIG. 3 along the line IV—IV.

In FIG. 3 the radial extensions 13 of rotor 2, which are also visible in FIG. 4. Dotted lines 91 show the outer face 91 of the rotor 2, while dotted lines 94 show the outer face of the recess 10 of rotor 2. Since the extensions 13 are axially shorter than the diameter of the cylinders 3, 103, the cross-recess 38 is formed in each cylinder in the rotor 2. In the upper portion of FIG. 3 is visible, how the extensions 13 enter beyond the inner face 32 of the guide ring 33 into the groove 12 of said ring 33. An in the bottom portion of FIG. 3 it is visible, how the extensions 6 of the piston shoe remain in the recess 10 of the rotor 2. Position referential 92 indicated the centre of the rotor 2, while reference 93 indicates the centre of the guide ring 33. Between referentials 91 and 93 is the eccentricity "e" visible, which defines the maximum piston stroke as 2 times *e.* Recesses 95 are provided in the outer face of the piston shoe extensions 6, 66 in order to limit the seal face 31 of the piston shoe for sealing the recesses 8. Thereby the seal area of the balancing recesses 8 is fixed to definite extensions for better dimensioning and restriction of the seal faces, wherein fluid may be present during seal. The cylinders are cited by referential 3 and 103 in order to make it clear, that the rotor can have a plurality of cylinder groups, namely 3 and 103. The piston shoe extensions 6 are cited by referential 6 for piston shoes of one of the cylinder groups and by referentials 66 for piston shoes of the other pistons shoe group.

FIG. 4 demonstrates how the piston shoes enter the recesses between the extensions 13 of the rotor 2 and it also demonstrates, how the piston shoes of a plurality of piston shoe groups are located relatively to each other. One extension 6 of a piston shoe of one of the piston shoe groups is located adjacent to one or more extensions 66 of the piston shoe or shoes of the other piston shoe group. Thus, no piston shoe can move axially out of its place, because the adjacent extension 6 or 66 of the piston shoe of the other piston shoe group prevents such dislocation. FIG. 4 also shows the prefered extension of the balancing grooves 8 in the piston shoe outer faces 31.

Figure 5:
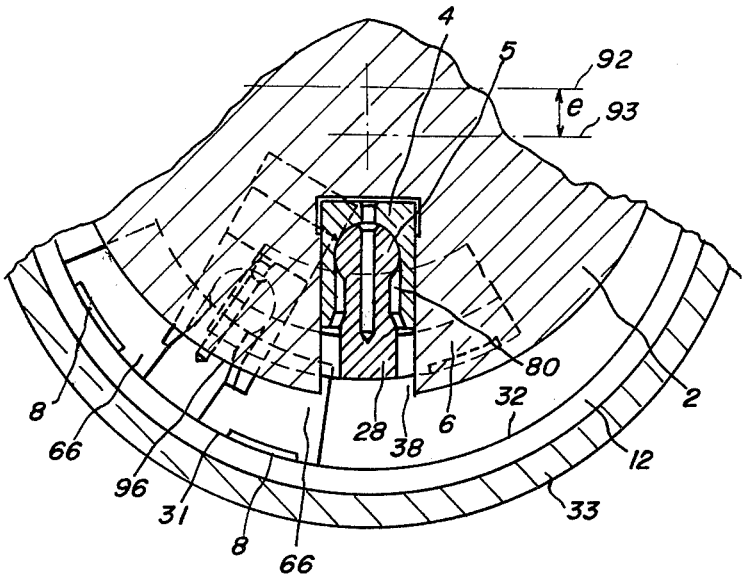
FIG. 5 is a somewhat similar section like FIG. 3, but showing only a part thereof and demonstrating an outermost and an innermost located piston and piston shoe and their association relatively to each other.

FIG. 5 demonstrates one piston 4 and piston shoe with extensions 6 in an radially innermost position. In dotted lines and partially full lines as far as visible, the piston shoe with extensions 6 of the other piston shoe group is demonstrated in a radially outermost position. It is assumed, that innermost position of the one piston shoe is due to an accident, for example by sticking due to dust in the device or due to deformation in the device. The piston shoe with extensions 66 could then axially dislocate and run outwardly of the piston shoe with extensions 6 of the other group, whereby also the pistons shoe with extension 6 and that with extension 66 would or could be disturbed. The means of the invention, that the radial extensions 6 and 66 of the pistonshoes are larger, than one half of the pistonstroke prevents such dislocation of the piston shoes which without this means of the invention would or could occure. The area 96 of the dotted lines shows, how the adjacent faces of pistonshoes of different groups prevent such axial dislocation according to the invention.

The machine according to the present invention provides a construction wherein the piston shoes 1 are suitable for operation even under conditions of extremely high pressure, and in which the piston shoes cannot tilt, wobble or otherwise assume undesirable positions in either radial or axial direction of the rotor. Moreover, the piston shoes are so guided and retained in the pistons 4 that they will always automatically return to their seat in the respective piston 4, and will automatically be centered with respect to the seat as they approach the same. Evidently, there is no fixed connection between piston and piston shoe, and therefore there is no possibility that such a connection might break or otherwise become damaged as in the prior art, and might cause the difficulties which have been outlined earlier with respect to the prior art. This makes the construction according to the present invention particularly suitable not only for high and extremely high pressures, but also for high and extremly high rotational speeds.

It will be understood that each of the elements described above, or two or more together, may also find a useful application in other types of constructions differing from tje type described above.

While the invention has been illustrated and described as embodied in a radial-piston fluid-handling machine, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and described to be protected by Letters Patent is set forth in the appended claims.

1. In a radial-piston fluid-handling machine, a combination comprising a housing; a rotor rotatably mounted in said housing and formed with at least two groups of radially oriented working chambers; fluid passages communicating with said working chambers; at least two groups of pistons, each piston being reciprocably received in a working chamber of one of said groups; a common actuator means for said pistons; a piston shoe for each of said pistons in engagement with said actuator means, each piston shoe having in axial direction of said rotor an outer end and an inner end, said inner ends of the piston shoes of one group of pistons being located adjacent the inner ends of the piston shoes of the other groups of pistons; guide means for retaining said outer ends of said piston shoes; and radial extensions on said inner ends and each located adjacent an inner end of a piston shoe of the respective other group of piston.

2. A combination as defined in claim 1, wherein said rotor has a medial groove extending inwardly of the rotor and adapted to intermittently receive said radial extensions.

3. The combination of claim 1, wherein radial plane faces are provided for holding said piston shoes axially in the desired location.

4. A combination as defined in claim 1, said actuator means comprising a control ring, said pistons being reciprocable through strokes of a first length, each piston having a recess extending inwardly from its outer end by a greater second length, and each piston shoe having a first portion in sliding contact with said control ring and a second portion extending from said first portion by a third length greater than said first length but at most equal to said second length and which is freely received in said recess of the associated piston.

5. A combination as defined in claim 4, wherein each of said first portions is provided with sections which extend beyond the outline of the associated cylinder, each of said sections having a guide face which is contoured matingly with reference to said control face and has a length greater than the radial length of the associated piston shoe.

6. A combination as defined in claim 4, wherein said rotor is provided with radially projecting axially spaced wall portions; and wherein said first portions of the respective piston shoes extend intermediate but are out of contact with said wall portions.

7. A combination as defined in claim 4, said rotor having an outer circumferential surface formed with an annular circumferentially extending groove; and wherein each of said first portions has said radial extension which extends radially inwardly of said rotor and into said groove.

8. A combination as defined in claim 4, said recesses each forming a seat of equal radius around a medial point within said respective piston; and wherein said second portion of each piston shoe includes a matingly configurated section engageable with said heat, and an elongated section of lesser diameter than said seat and connecting the latter with said first portion.

9. A combination as defined in claim 4, said rotor having an outer cirumferential surface formed with recess means; and wherein each of said first portions has said radial extension which extends radially inwardly of said rotor and into said recess means.

10. A combination as defined in claim 9, wherein said radial extensions have a radial length which is greater than a half of said first length.

11. A combination as defined in claim 9, wherein said pistons and the associated piston shoes are arranged in at least two groups which are spaced axially of said rotor; and wherein said projections of the piston shoes in the respective groups are closely adjacent one another in direction axially of said rotor.

* * * * *